US007635066B2

(12) United States Patent
Harrison

(10) Patent No.: US 7,635,066 B2
(45) Date of Patent: Dec. 22, 2009

(54) REVOLVING STORAGE DEVICE

(76) Inventor: Terrence M. Harrison, 310 Christy Rd., Eighty-Four, PA (US) 15330

( * ) Notice: Subject to any disclaimer, the term of this patent is extended or adjusted under 35 U.S.C. 154(b) by 0 days.

(21) Appl. No.: 12/248,459

(22) Filed: Oct. 9, 2008

(65) Prior Publication Data

US 2009/0090835 A1 Apr. 9, 2009

Related U.S. Application Data

(60) Provisional application No. 60/998,113, filed on Oct. 9, 2007.

(51) Int. Cl.
*B65D 1/36* (2006.01)

(52) U.S. Cl. ..... 220/503; 211/77; 211/168; 206/765; 248/346.5; 248/349.1

(58) Field of Classification Search ..... 248/346.03, 248/346.5, 349.1; 206/765; 211/77, 78, 211/163, 131.1; 220/503, 505, 506, 507, 220/553, 555

See application file for complete search history.

(56) References Cited

U.S. PATENT DOCUMENTS

| | | | | |
|---|---|---|---|---|
| 1,878,302 | A | 9/1932 | Tourtois | |
| 2,281,849 | A | 5/1942 | McCoppin | |
| 2,553,880 | A | 5/1951 | Stigler | |
| 2,719,413 | A | 10/1955 | Panzer | |
| 2,723,763 | A | 11/1955 | Baldwin | |
| 3,848,943 | A | 11/1974 | Geesaman et al. | |
| 4,453,326 | A | 6/1984 | Hoffman et al. | |
| D279,950 | S | 8/1985 | Wan | |
| 4,566,664 | A * | 1/1986 | Donald | 248/349.1 |
| 4,573,856 | A * | 3/1986 | Meyer et al. | 414/561 |
| 4,697,856 | A | 10/1987 | Abraham | |
| 4,753,340 | A | 6/1988 | Blakeman et al. | |
| 4,775,055 | A | 10/1988 | Morse | |
| 4,881,651 | A | 11/1989 | Mimoun et al. | |
| 4,915,239 | A | 4/1990 | Persch | |
| D310,940 | S | 10/1990 | Kastanek | |
| 5,361,915 | A | 11/1994 | Cohen et al. | |
| 5,377,850 | A | 1/1995 | Liaw | |
| D367,408 | S | 2/1996 | Fordyce | |
| 5,524,775 | A | 6/1996 | Kaine | |
| 5,765,796 | A * | 6/1998 | Lanus | 248/349.1 |
| 5,895,022 | A * | 4/1999 | Kim | 248/398 |
| 5,941,252 | A | 8/1999 | Jenkins et al. | |
| D418,947 | S | 1/2000 | Greiner | |
| 6,029,028 | A | 2/2000 | Inoue | |
| 6,047,833 | A * | 4/2000 | Salomon | 206/765 |
| 6,182,839 | B1 | 2/2001 | Robbins et al. | |
| 6,189,711 | B1 | 2/2001 | Chang | |

(Continued)

*Primary Examiner*—Ramon O Ramirez
(74) *Attorney, Agent, or Firm*—The Webb Law Firm

(57) ABSTRACT

A storage device has a first and second supporting surface. The first and second supporting surfaces are connected to each other by a first riser. The first and second supporting surfaces each have lips. The distance between the lip for the first supporting surface and the first riser defines the storage area on the first supporting surface. The storage device may also have a third supporting surface positioned below the second supporting surface and may further have one or more pockets located on the first supporting surface. The storage device may also have a stationary base wherein at least a portion of the storage device is capable of rotating about an axis.

14 Claims, 6 Drawing Sheets

U.S. PATENT DOCUMENTS

| | | | | |
|---|---|---|---|---|
| 6,220,443 | B1 | 4/2001 | Damaskos | |
| D444,999 | S | 7/2001 | Govrik et al. | |
| 6,364,125 | B1 | 4/2002 | D'Angelo | |
| 6,439,406 | B1 | 8/2002 | Duhon | |
| 6,585,119 | B2 | 7/2003 | Palder | |
| 6,588,609 | B1 | 7/2003 | Richet et al. | |
| D490,848 | S | 6/2004 | Pope et al. | |
| 6,742,674 | B2 | 6/2004 | Castleberry | |
| 6,796,443 | B2 | 9/2004 | Lippman et al. | |
| D510,388 | S | 10/2005 | Siegel | |
| 7,131,618 | B2 * | 11/2006 | Berry et al. | 248/346.05 |
| 7,156,226 | B1 | 1/2007 | Van Sickle | |
| 2003/0121873 | A1 | 7/2003 | Lippman et al. | |
| 2003/0196970 | A1 | 10/2003 | Jiang | |
| 2003/0222042 | A1 | 12/2003 | Richet et al. | |
| 2008/0042035 | A1 * | 2/2008 | Elwood | 248/346.03 |

* cited by examiner

REVOLVING STORAGE DEVICE

CROSS REFERENCE TO RELATED APPLICATIONS

This Application claims the benefit of U.S. provisional patent application No. 60/998,113 filed on Oct. 9, 2007, the disclosure of which is expressly incorporated herein.

SUMMARY OF THE INVENTION

The present invention is generally directed to a storage device for boxed or bottled goods.

In one embodiment, the storage device comprises a first supporting surface. A first lip borders an outer perimeter of the first supporting surface. A first riser is connected to the first supporting surface at a first inner location of the first supporting surface. The first riser and the first lip define a first storage space on the first supporting surface. A second supporting surface is supported by the first riser. A second lip borders an outer perimeter of the second supporting surface.

In another embodiment, the storage device comprises a first supporting surface. A first lip borders an outer perimeter of the first supporting surface. A first riser is connected to the first supporting surface at a first inner location of the first supporting surface. The first riser and the first lip define a first storage space on the first supporting surface. A second supporting surface is supported by the first riser. A second lip borders an outer perimeter of the second supporting surface. A third supporting surface is supported by the second riser, wherein the third supporting surface is positioned below the second supporting surface.

In another embodiment, the storage device may further comprise a stationary base so that at least a portion of the storage device may rotate about an axis.

In another embodiment, the storage has a pocket comprising a first wall, a second wall and a third wall. The first wall has an outer side, an inner side, a top and a bottom. A portion of the outer side of the first wall is connected to a portion of the first lip. A portion of the inner side of the first wall is connected to a portion of the third wall or the first riser. A portion of the bottom of the first wall is connected to a portion of the first supporting surface. The second wall has an outer side, an inner side, a top and a bottom. A portion of the outer side of the second wall is connected to a portion of the first lip. A portion of the inner side of the second wall is connected to a portion of the third wall or the first riser. A portion of the bottom of the second wall is connected to a portion of the first supporting surface.

BRIEF DESCRIPTION OF THE DRAWING(S)

DETAILED DESCRIPTION OF THE PREFERRED EMBODIMENTS

Figure 1:
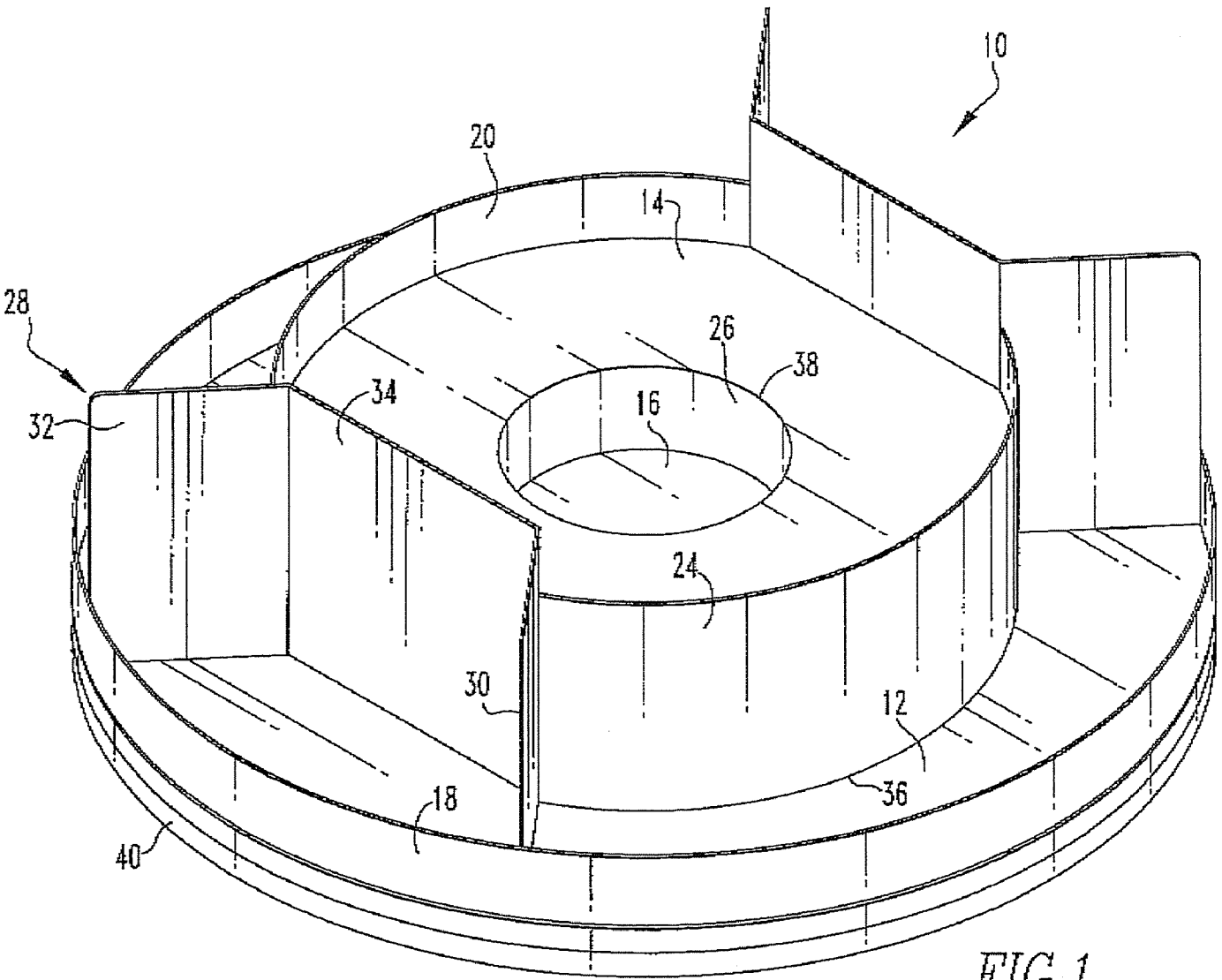
FIG. 1 is a perspective view of a storage device for boxed and bottled goods.
Figure 2:
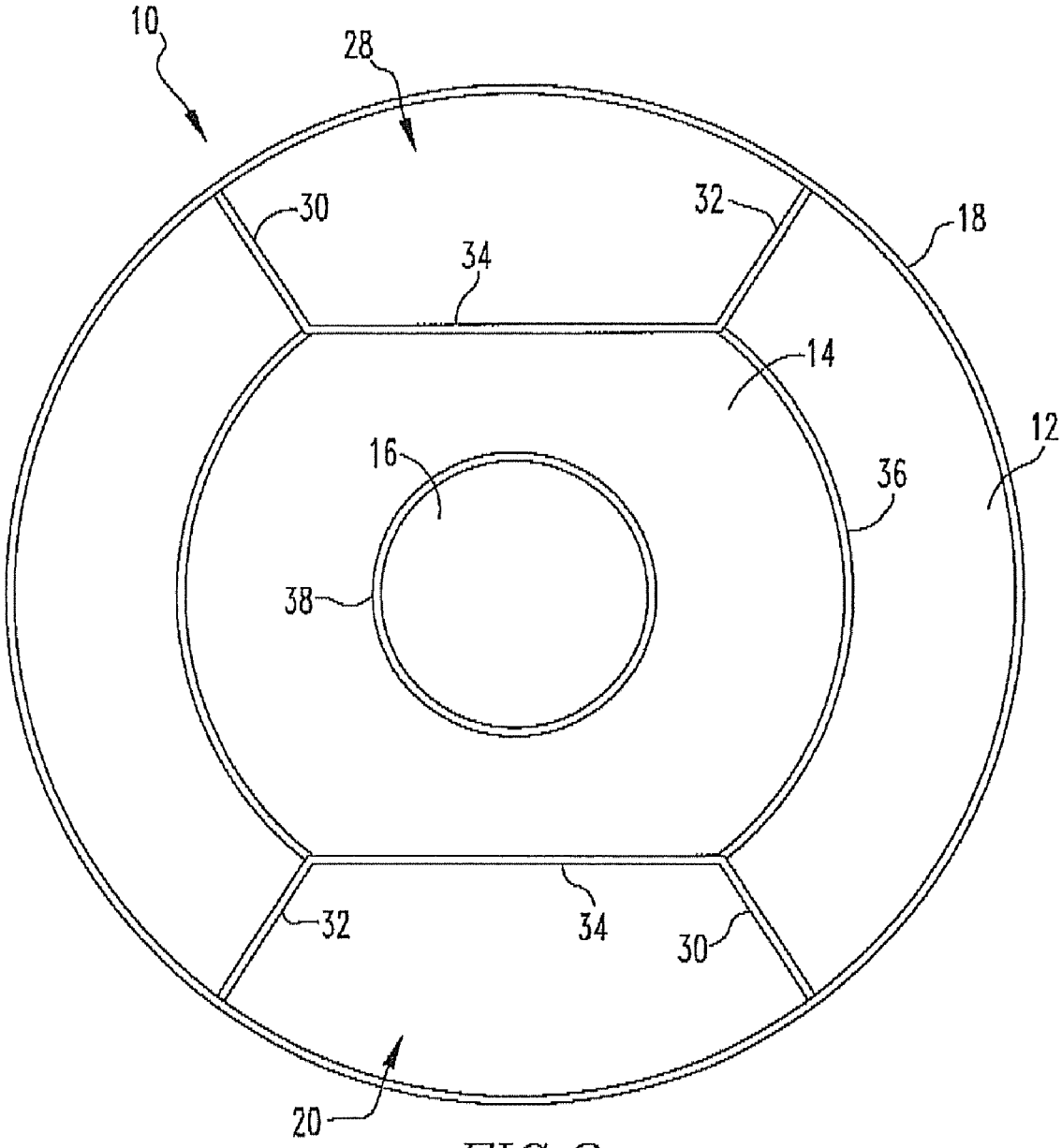
FIG. 2 is a top view of the storage device.
Figure 3:
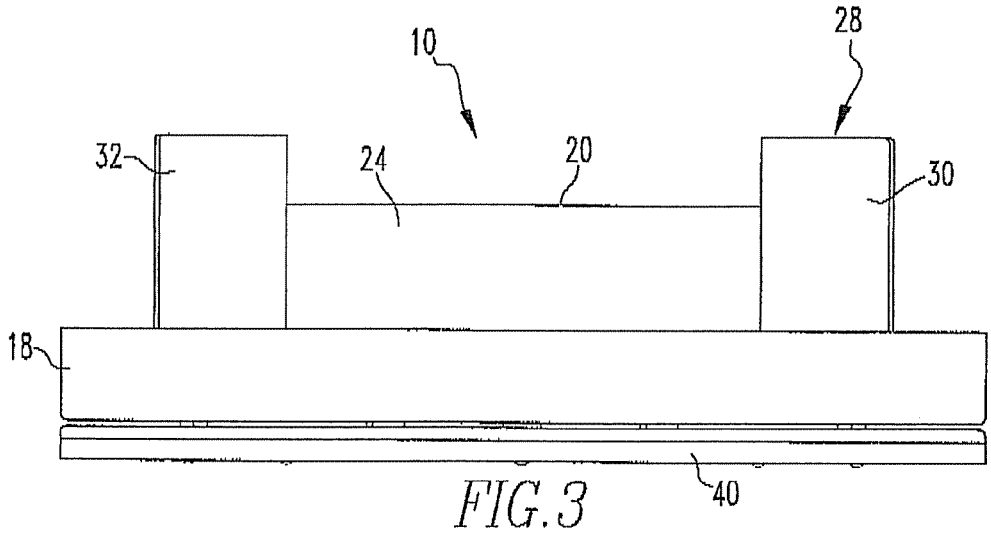
FIG. 3 is a front view of the storage device where the pockets are depicted to the left and right portions of the storage device.
Figure 4:
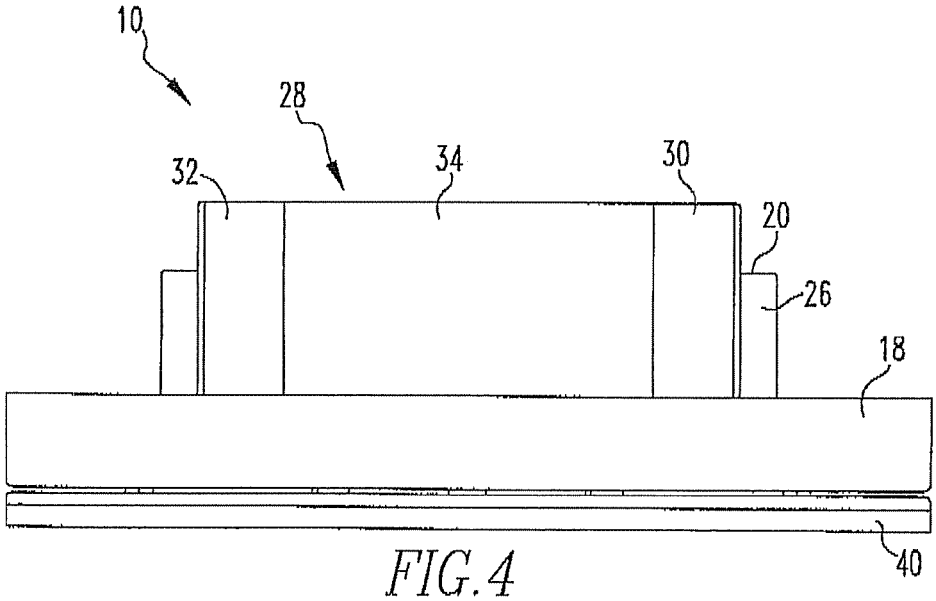
FIG. 4 is a side view of the storage device where one of the pockets is depicted in the front of the storage device.
Figure 5:
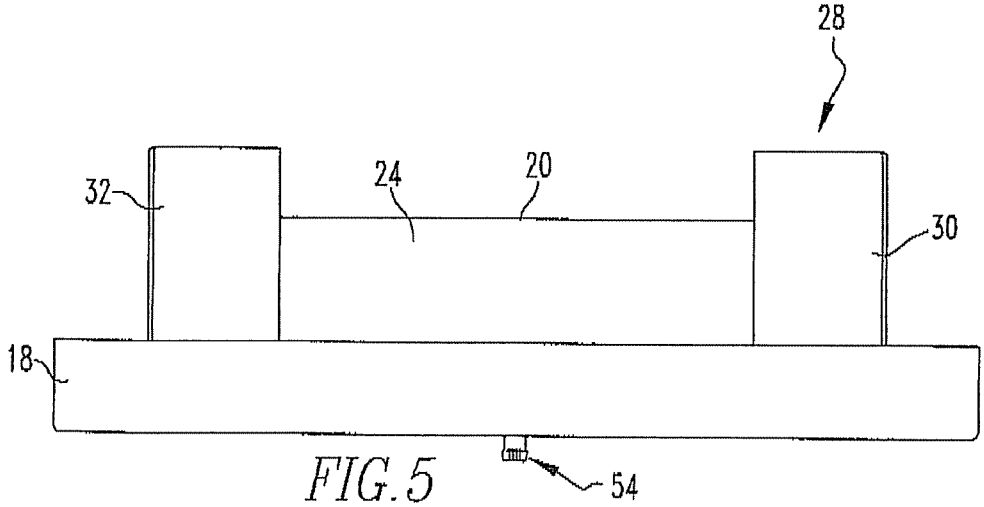
FIG. 5 is a front view of a portion of the storage device that depicts an axle that attaches to an aperture of the stationary base.
Figure 6:
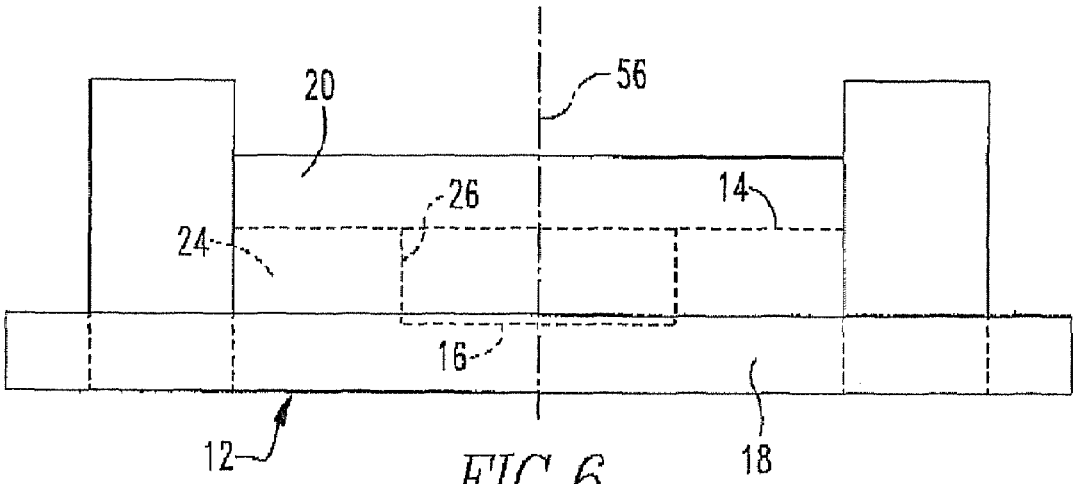
FIG. 6 is a schematic of the storage device from a front view where the pockets are depicted to the left and right portions of the storage device.
Figure 7:
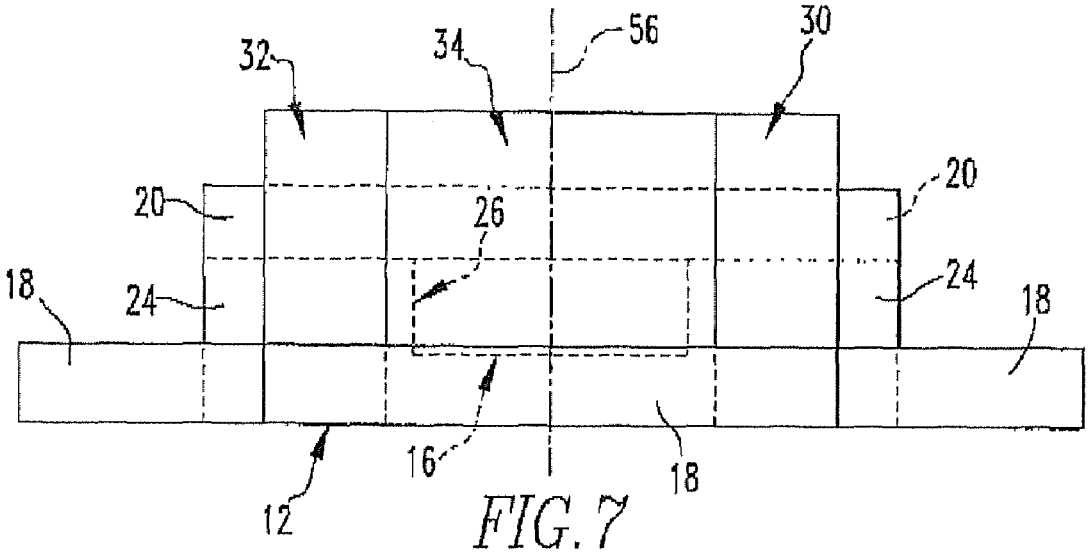
FIG. 7 is a schematic of the storage device from a side view where a pocket is depicted in the front of the storage device.
Figure 8:
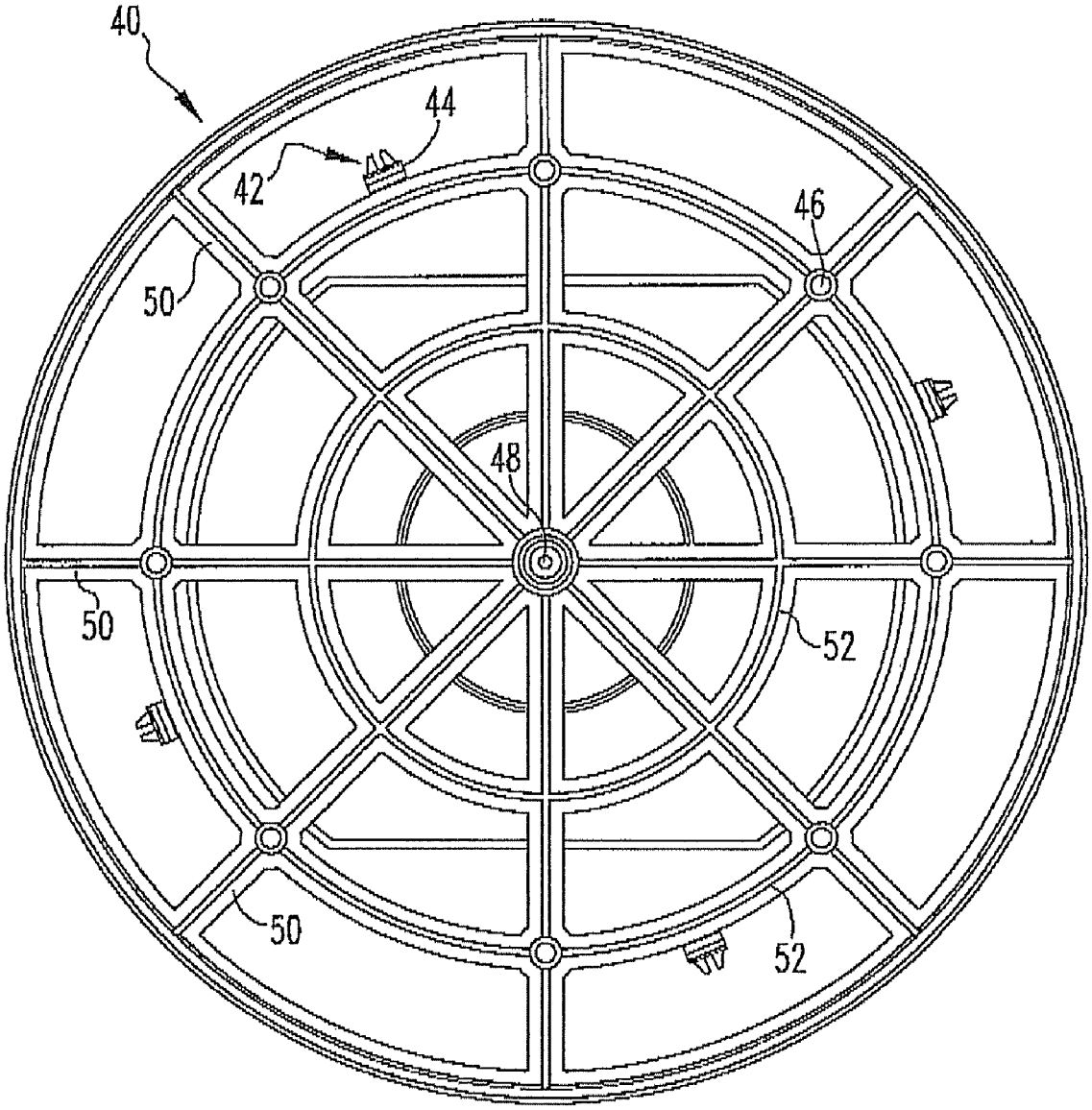
FIG. 8 is a bottom view of the storage device and stationary base.
Figure 9:
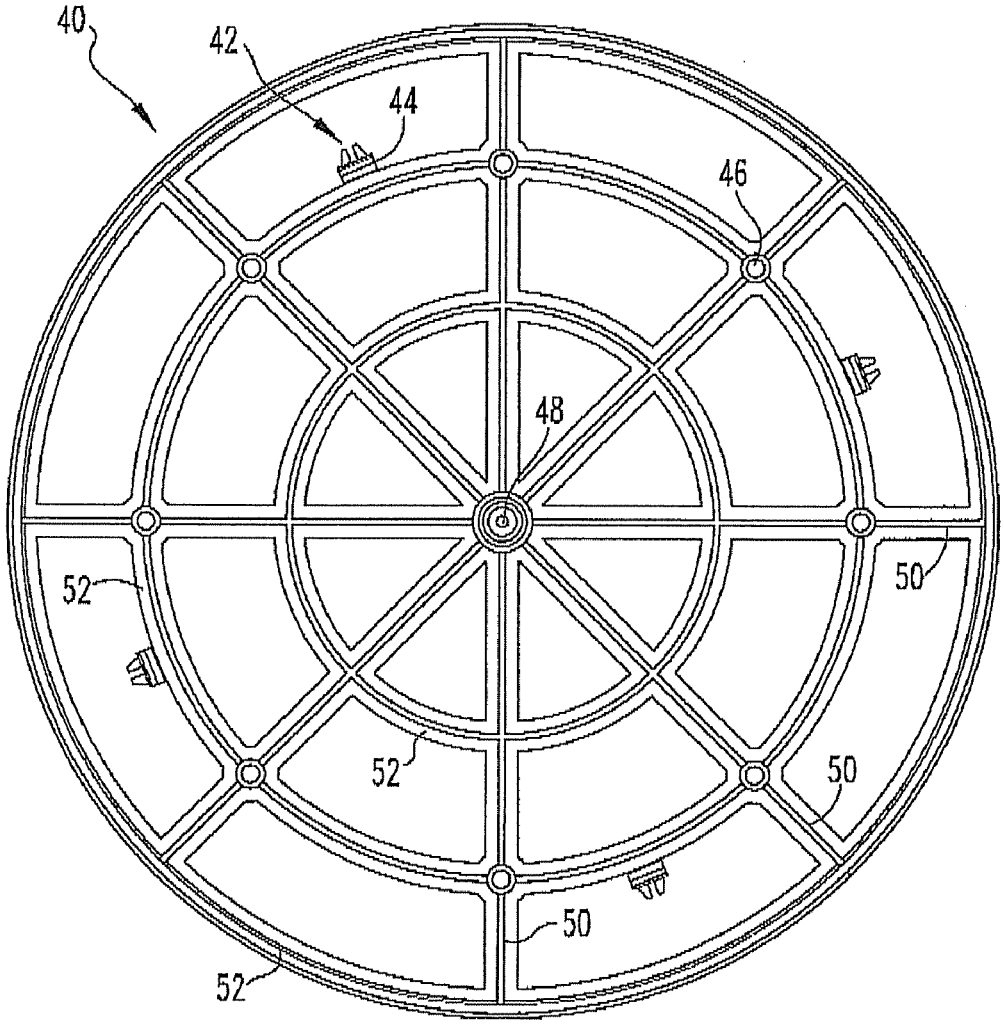
FIG. 9 is a bottom view of the stationary base for the storage device.
Figure 10:
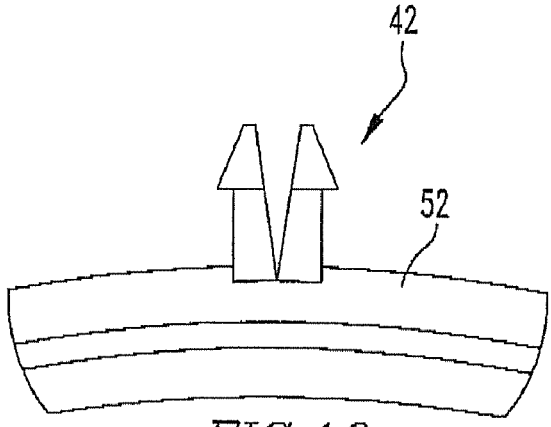
FIG. 10 is a detail of a snap-lock for the wheel part of the stationary base.

A complete understanding of the present invention will be obtained from the following description taken in connection with the accompanying drawing figures, wherein the references identify the parts throughout. For the purposes of the following description, the terms "above", "below", "top", "bottom", and derivatives thereof refer to the invention as oriented in the drawing figures. The term "inner" and derivatives thereof refers to a location closer to the center of the invention. The term "outer" and derivatives thereof refers to a location furthest from the center of the invention.

It is understood that the use of the terms "connected to", "connected with" or any derivates thereof refers to elements used within the art and known to a skilled artisan that are capable of joining two elements. The terms are also understood to mean that two elements are "connected to" or "connected with" each other if one element is continuously formed into a second element, thereby encompassing two elements into a single uniting body.

It is understood that the invention may assume alternative variations, except where expressly specified to the contrary. It is also understood that the specific device and process illustrated in the attached drawings and described in the following specification are exemplary embodiments of the invention. Specific dimensions and other physical characteristics related to the embodiments disclosed herein are not considered to be limiting.

All numbers expressing quantities used in the specification and claims are to be understood as being modified in all instances by the term "about". Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Also, it should be understood that any numerical range recited herein is intended to include all sub-ranges subsumed therein. For example, a range of "1 to 10" is intended to include all sub-ranges between and including the recited minimum value of 1 and the recited maximum value of 10, that is, having a minimum value equal to or greater than 1 and a maximum value of equal to or less than 10.

The invention generally relates to a storage device 10 for boxed and bottled goods. The storage device 10 includes a first supporting surface 12.

In one embodiment, the first supporting surface 12 is circular. The first supporting surface 12 has a first diameter. The first diameter of the first supporting surface 12 may be in the range of 7" to 13", 8" to 11", 10" to 10¾", or 10¼" to 10½". In one embodiment, the first diameter of the first supporting surface 12 is about 10⅜".

The first supporting surface 12 has a first lip 18 connected to an outer perimeter of the first supporting surface 12. The first lip 18 has a first lip height in the range of ¼" to 2", 9/16" to 1½", or ¾" to 1¼". In one embodiment, the first lip height is about 1" measured from the first supporting surface to the top of the first lip.

The first supporting surface 12 also has a first riser 24 connected to the first supporting surface 12 at a first inner location 36. The first riser 24 has a first riser height, which may be in the range of 1½" to 4", 2" to 3", or 2¼" to 2¾". In one embodiment, the first riser height is about 2½".

The first lip 18 and the first riser 24 define a first storage space. The first storage space has a first width. The first width is appropriate in length to accommodate at least one standard medicine bottle. The first width may be in the range of ½" to 4", 1" to 3", or 1¼" to 1¾". In one embodiment, the first width is about 1½".

A second supporting surface 14 is connected to the first riser 24. The second supporting surface 14 may be connected to the first riser 24 at the top of the first riser 24, thereby; the first riser 24 has a height equal to a distance between the second supporting surface 14 and the first supporting surface 12. Alternatively, the second supporting surface 14 may be connected to the first riser 24 at some position below the top of the first riser 24 whereby the portion of the first riser 24 that extends above the second supporting surface 14 forms a portion of a second lip 20. In one embodiment, the second supporting surface 14 is circular having a second diameter. The second diameter of the second supporting surface 14 would be less than the first diameter of the first supporting surface 12, but large enough to accommodate desired bottles, for example, standard medicine bottles. The second diameter of the second supporting surface 14 may be in the range of 4" to 10", 5" to 8", or 7" to 7¾". In one embodiment, the second diameter of the second supporting surface 14 is about 7 5/16".

In another embodiment, the second supporting surface 14 is generally circular, wherein the circular shape is interrupted by a third wall 34, or by two third walls. In another embodiment, the distance between the first-third wall and the second-third wall is in the range of 4" to 10", 5" to 8", or 5½" to 6½". In one embodiment, the distance between the first-third wall and the second-third wall is about 6".

The second supporting surface 14 is connected to a second lip 20. The second lip 20 is connected to an outer perimeter of the second supporting surface 14. The second lip 20 has a second lip height in the range of ¼" to 2", or, 9/16" to 1½". In one embodiment, the second lip height is about ¾" from the second supporting surface to the top of the second lip.

In one embodiment, a second riser 26 is connected to the second supporting surface 14 at a second inner location 38 of the second supporting surface 14. The second riser 26 has a second riser height in the range of ½" to 4", or ¾" to 2". In one embodiment, the second riser height is about 1". In one embodiment, the top of the second riser 26 connects with the second supporting surface 14 at the second inner location 38. In another embodiment, the second inner location 38 of the second supporting surface 14 connects to an area below the top of the second riser 26, thereby creating a third lip, which is defined as the portion of the third riser that extends above the second riser 26.

Between the second inner location 38 and the second lip 20 is a second distance appropriate in length to support, for example, at least one standard medicine bottle. The second distance may be in the range of 1½" to 4", 2" to 3", or 2" to 2½". In one embodiment, the second distance between the second inner location 38 and the second lip 20 is about 2¼".

A third supporting surface 16 is connected to the second riser 26. The third supporting surface 16 is connected with the second riser 26 at the bottom of the second riser 26, or, alternatively, at a position between the top and bottom of the second riser 26. In one embodiment, the third supporting surface 16 is positioned below the second supporting surface 14. The third supporting surface 16 has a third supporting surface diameter that is appropriate in size to accommodate a large medicine bottle. The diameter may be in the range of 1" to 5", 2" to 4", or 2½" to 3". In one embodiment, the diameter of the third supporting surface 16 is about 2 13/16".

In one embodiment, the storage device 10 comprises two supporting surfaces. In another embodiment, the storage device 10 comprises three supporting surfaces.

In another embodiment, a pocket 28 having three walls is connected to the first supporting surface 12. The pocket 28 is so designed to accommodate, for example, at least one boxed good. The first wall 30 has an outer side, an inner side, a top and a bottom. At least a portion of the outer side of the first wall 30 is connected to at least a portion of the first lip 18. At least a portion of the inner side of the first wall 30 is connected to at least a portion of the third wall 34 or the first riser 24. A portion of the bottom of the first wall 30 is connected to at least a portion of the first supporting surface 12. The second wall 32 has an outer side, an inner side, a top and a bottom. At least a portion of the outer side of the second wall 32 is connected to at least a portion of the first lip 18. At least a portion of the inner side of the second wall 32 is connected to at least a portion of the third wall 34 or the first riser 24. At least a portion of the bottom of the second wall 32 is connected to at least a portion of the first supporting surface 12. At least a portion of the third wall 34 forms or is in contact with at least a portion of the first riser 24 and at least a portion of the second lip 20.

The third wall 34 has a third wall height. In one embodiment, the third wall height is equal to the combined height of the first riser height and the second lip height. In another embodiment, the third wall height is greater than the first riser height and the second lip height. In another embodiment, the third wall height is less than the combined height of the first riser height and the second lip height. The third wall height may be in the range of 1" to 5", 2" to 4", or 3" to 3½". In one embodiment, the third wall height is about 3¼".

A distance between the first lip 18 and the third wall 34 exists along the first supporting surface 12. Since the first lip 18 may be generally circular in shape, the distance between the first lip 18 and the third wall 34, as measured along the first supporting surface 12 may vary from a furthest distance to a shortest distance. The furthest distance between the first lip 18 and the third wall 34 as measured along the first supporting surface 12 is in the range of ½" to 4", 1" to 3", or 2" to 2½". In one embodiment, the furthest distance from the first lip 18 to the third wall 34 is 2 9/32".

The first wall 30 has a first wall height. In one embodiment, the first wall height is equal to the third wall height. In another embodiment, the first wall height is less than the height of the third wall 34. In another embodiment, the first wall height is greater than the third wall height. The first wall height may be in the range of 1" to 5", 2" to 4", or 3" to 3½". In one embodiment, the first wall height is about 3¼".

The first wall 30 has a first wall length that is the distance between the outer side of the first wall 30 and the inner side of the first wall 30. The first wall length is appropriate to accommodate, for example, a boxed good. The first wall length, as measured from the outer side of the first wall 30 to the inner side of the first wall 30, may be in the range of ½" to 4", 1" to 3", or 1¼" to 1¾". In one embodiment, the first wall length is about 1 15/32" measured from the outer side of the first wall 30 to the inner side of the first wall 30.

The inner side of the first wall 30 is connected with the third wall 34 in a manner that forms an angle between the first wall 30 and the third wall 34. The angle between the first wall 30 and the third wall 34 may be in the range at 90 degrees to 150 degrees, 100 degrees to 135 to degrees, or 120 degrees to 130 degrees. In one embodiment, the angle between the first wall 30 and the third wall 34 is about 124 degrees.

The second wall 32 has a second wall height. In one embodiment, the second wall height is equal to the height of the third wall 34. In another embodiment, the second wall height is less than the height of the third wall 34. In another embodiment, the second wall height is greater than the third wall height. The first wall height may be in the range of ½" to 5", 1" to 4", or 3" to 5½". In one embodiment, the second wall height is about 3¼".

The second wall 32 has a second wall length that is the distance between the outer side of the second wall 32 and the inner side of the second wall 32. The second wall length is appropriate to accommodate, for example, a boxed good. The second wall length, as measured from the outer side of the second wall 32 to the inner side of the second wall 32, may be in the range of ½" to 4", 1" to 3", or 1¼" to 1¾". In one embodiment, the second wall length is about 1 15/32" measured from the outer side of the second wall 32 to the inner side of the second wall 32.

The inner side of the second wall 32 is connected with the third wall 34 in a manner that forms an angle between the second wall 32 and the third wall 34. The angle between the second wall 32 and the third wall 34 may be in the range of 90 degrees to 150 degrees, from 100 degrees to 135 degrees, from 120 degrees to 130 degrees. In one embodiment, the angle between the second wall 32 and the third wall 34 is about 124 degrees.

The third wall 34 has a third wall length. The third wall length is equal to a distance that can accommodate, for example, a boxed good such as a standard medicine box. The third wall length, as measured from the left side of the third wall 34 to the right side of the third wall 34, may be in the range of 1" to 7", 2" to 5", or 4" to 4½". In one embodiment, the third wall length is about 4 9/32" measured from the left side of the third wall 34 to the right side of the third wall 34.

In one embodiment, the storage device 10 further comprises a pocket 28. In another embodiment, the storage device 10 comprises two pockets.

Optionally, the storage device 10 may further comprise a stationary base 40. The stationary base 40 would be adapted to rest on a desired surface. Examples of desired surfaces include kitchen counters and kitchen cabinet shelves. The stationary base 40 is connected to the storage device 10 in a manner that allows at least a portion of the storage device 10 to rotate about an axis 56.

In one embodiment, the stationary base 40 comprises a plurality of straight supports 50 having a center, and a plurality of circular supports 52. The straight supports and the circular supports intersect at a plurality of junctions. At least some of the junctions have feet 46. The center of the straight supports 50 has an aperture 48 configured to engage with an axle 54 that extends from the bottom of the first supporting surface 12, second supporting surface 14 or third supporting surface 16 at approximately a center of the respective supporting surface 12, 14 or 16.

In one embodiment, the stationary base 40 comprises a plurality of snap-locks 42. The snap-locks 42 extend from at least one of the circular supports. Corresponding wheels 44 attach to snap-locks 42. The wheels engage a bottom portion of the first support surface in a manner to allow the first supporting surface 12 to rotate about the axis 56.

One of ordinary skill in the art would recognize alternate configurations for attaching wheels to the first circle support. One of ordinary skill in the art would also recognize alternate configurations for the stationary base 40 that would allow the first supporting surface 12 to rotate about the axis 56.

The feet 46 secure the storage device to prevent against sliding. They can be constructed from any material commonly used to prevent an article from sliding. For example, in one embodiment, the feet are constructed of rubber.

In one embodiment, the axle 54 comprises a snap-lock configured to engage the aperture 48 of the stationary base 40. The axle 54 engages the aperture 48 in a manner that allows the first supporting surface 12 to rotate about the axis 56.

The storage device 10 is made of suitable materials, which would be known to one skilled in the art. Suitable materials include, but are not limited to, wood, plastic and metals. In one embodiment, the storage device 10 is made from wood. In another embodiment, the storage device 10 is made from plastic. In another embodiment, the storage device 10 is made from metal. In another embodiment, the storage device 10 is made from stainless steel.

The invention claimed is:

1. A storage device comprising:

a first supporting surface;

a first lip bordering an outer perimeter of the first supporting surface;

a first riser connected to the first supporting surface at a first inner location of the first supporting surface, wherein the first riser and the first outer lip define a first storage space on the first supporting surface;

a second supporting surface connected to the first riser; and a second lip bordering an outer perimeter of the second supporting surface;

a second riser connected to the second supporting surface at a second inner location of the second supporting surface; and a third supporting surface connected to the second riser, wherein the third supporting surface is positioned below the second supporting surface.

2. The storage device of claim 1, wherein the third supporting surface has a diameter of about 1 inch to about 5 inches.

3. The storage device of claim 1 further comprising an axle extending from a bottom of the third supporting surface, the axle engaging an aperture positioned approximately at a center of a stationary base in a manner that permits at least a portion of the storage device to rotate about an axis.

4. A storage device comprising:

a first supporting surface;

a first outer lip bordering an outer perimeter of the first supporting surface;

a first riser connected to the first supporting surface at an first inner location of the first supporting surface, wherein the first riser and the first outer lip define a first storage space on the first supporting surface;

a second supporting surface connected to the first riser;

a second lip bordering an outer perimeter of the second supporting surface; and a first pocket positioned on the first support surface comprising a first wall, a second wall and a third wall that define a first pocket space on the first supporting surface;

the first wall comprises an outer side, an inner side, a top and a bottom, wherein a portion of the outer side of the first wall connects with a portion of the first lip, wherein a portion of the inner side of the first wall connects with a portion of the third wall or first riser, and wherein a portion of the bottom of the first wall connects with a portion of the first supporting surface;

the second wall comprises an outer side, an inner side, a top and a bottom, wherein a portion of the outer side of the second wall connects with a portion of the first lip, wherein a portion of the inner side of the second wall connects with a portion of the third wall or first riser, and wherein a portion of the bottom of the second wall connects with a portion of the first supporting surface; and a stationary base connected to the storage device in a manner to allow at least a portion of the storage device to rotate about an axis.

5. The storage device of claim 4 further comprising:

a second riser having a second riser height connected to the second supporting surface at a second inner location of the second supporting surface; and a third supporting surface connected to the second riser, wherein the third supporting surface is positioned below the second supporting surface.

6. The storage device of claim 5 further comprising a second pocket positioned on the first support surface approximately opposite of the first pocket; the second pocket comprises a first wall, a second wall and a third wall that define a second pocket space on the first supporting surface, the first wall of the second pocket comprises an outer side, an inner side, a top and a bottom, wherein a portion of the outer side of the first wall of the second pocket connects with a portion of the first lip, wherein a portion of the inner side of the first wall of the second pocket connects with a portion of the third wall, and wherein a portion of the bottom of the first wall of the second pocket connects with a portion of the first supporting surface;

the second wall of the second pocket comprises an outer side, an inner side, a top and a bottom, wherein a portion of the outer side of the second wall of the second pocket connects with a portion of the first lip, wherein a portion of the inner side of the second wall of the second pocket connects with a portion of the third wall, and wherein a portion of the bottom of the second wall of the second pocket connects with a portion of the first supporting surface; and an axle extending from a bottom of the third supporting surface configured to engage an aperture positioned at approximately a center of the stationary base in a manner to allow at least a portion of the storage device to rotate about the axis, wherein the stationary base comprises a plurality of wheels that engage a bottom surface of the first supporting surface.

7. The storage device of claim 5, wherein the second riser and the second inner location define a first portion of a second storage space having a width of about 1.5 inches to about 4 inches.

8. The storage device of claim 4, wherein the third wall has a height of about 1 inch to about 5 inches.

9. The storage device of claim 4, wherein the first wall and the third wall of the first pocket are connected at an angle between about 90 degrees and about 150 degrees.

10. The storage device of claim 4, wherein a maximal distance along the first supporting surface between the third wall of the first pocket and the first lip is about 0.5 inches to about 4 inches.

11. The storage device of claim 4, wherein the first wall has a length between the first lip and the first riser of about 0.5 inches to about 4 inches.

12. The storage device of claim 4, wherein the second wall has a length between the first lip and the first riser of about 0.5 inches to about 4 inches.

13. The storage device of claim 4, wherein the third wall has a length between the first lip and the first riser of about 1 inch to about 7 inches.

14. The storage device of claim 4, wherein the third wall extends from the first support surface to a height between about 1 inch to about 5 inches.

* * * * *